US006139425A

United States Patent [19]

Yazici et al.

[11] Patent Number: 6,139,425

[45] Date of Patent: Oct. 31, 2000

[54] HIGH EFFICIENCY AIR MIXER

[75] Inventors: Muammer Yazici, Etobicoke; Ming Hui Han, Mississauga, both of Canada

[73] Assignee: Air Handling Engineering Ltd., Buffalo, N.Y.

[21] Appl. No.: 09/298,377

[22] Filed: Apr. 23, 1999

[51] Int. Cl.[7] ..... F24F 13/04

[52] U.S. Cl. ..... 454/261

[58] Field of Search ..... 454/261, 262, 454/263, 269; 110/227, 265, 303, 309, 267, 218, 106

[56] References Cited

U.S. PATENT DOCUMENTS

| | | | |
|---|---|---|---|
| 1,395,938 | 11/1921 | Barducci . | |
| 1,699,899 | 1/1929 | Little | 454/261 |
| 3,911,804 | 10/1975 | Tao | 454/261 |
| 4,255,124 | 3/1981 | Baranowski, Jr. . | |
| 4,495,858 | 1/1985 | Erickson . | |
| 4,793,247 | 12/1988 | Verweij . | |
| 5,368,521 | 11/1994 | Koenig . | |
| 5,463,967 | 11/1995 | Gielow et al. . | |
| 5,484,203 | 1/1996 | King et al. . | |
| 5,632,675 | 5/1997 | Kanninen et al. | 454/263 |

FOREIGN PATENT DOCUMENTS 1430687 1/1987 U.S.S.R. .

*Primary Examiner*—Pamela Wilson
*Assistant Examiner*—Michelle A Mattera
*Attorney, Agent, or Firm*—Barry R. Lipsitz

[57] ABSTRACT

An air mixer for an air distribution system for a building includes a set of fixed, substantially parallel partitions arranged in a spaced-apart, side-by-side manner, these partitions forming alternating primary and secondary air passageways. The primary air passageways are open-ended and extend from a front side to a rear side of the mixer. Front end plates extend respectively across front sides of the secondary air passageways and each has elongate edge portions extending along two opposite longitudinal edges thereof. Each elongate edge portion projects beyond the plane defined by an adjacent one of the partitions. Air flow splitters are mounted in the secondary air passageways and each is connected to an adjacent pair of the partitions. These splitters in operation of the mixer turn incoming air flow that enters the secondary air passageways towards the front end plates. Air gaps are formed between the elongate edge portions and front edges of the partitions to enable the air flow in the secondary air passageways to enter the primary passageways where the two air flows are mixed.

24 Claims, 4 Drawing Sheets

| T=(273+°C) °K | |
|---|---|
| 27 | 2.955E+02 |
| 25 | 2.934E+02 |
| 24 | 2.924E+02 |
| 23 | 2.914E+02 |
| 21 | 2.893E+02 |
| 20 | 2.882E+02 |
| 19 | 2.872E+02 |
| 17 | 2.851E+02 |
| 16 | 2.841E+02 |
| 15 | 2.830E+02 |
| 14 | 2.820E+02 |
| 12 | 2.799E+02 |
| 11 | 2.789E+02 |
| 10 | 2.778E+02 |
| 8 | 2.757E+02 |
| 7 | 2.747E+02 |
| 6 | 2.737E+02 |
| 4 | 2.716E+02 |
| 3 | 2.705E+02 |
| 2 | 2.695E+02 |
| 1 | 2.685E+02 |

| T=(273+°C)°K | |
|---|---|
| 27 | 2.948E+02 |
| 25 | 2.927E+02 |
| 24 | 2.917E+02 |
| 23 | 2.907E+02 |
| 21 | 2.887E+02 |
| 20 | 2.876E+02 |
| 19 | 2.866E+02 |
| 17 | 2.846E+02 |
| 16 | 2.836E+02 |
| 15 | 2.826E+02 |
| 14 | 2.815E+02 |
| 12 | 2.795E+02 |
| 11 | 2.785E+02 |
| 10 | 2.775E+02 |
| 8 | 2.754E+02 |
| 7 | 2.744E+02 |
| 6 | 2.734E+02 |
| 4 | 2.713E+02 |
| 3 | 2.703E+02 |
| 2 | 2.693E+02 |
| 1 | 2.683E+02 |

HIGH EFFICIENCY AIR MIXER

BACKGROUND OF THE INVENTION

This invention relates to air mixers for mixing together two different air flows, particularly an air mixer for an air distribution system suitable for a building or other similar structure.

In air handling systems designed for large buildings such as office towers and other large structures, there has been a need to mix together at least two different air flows before distributing the mixed air flow throughout the air ducts of the building by means of a fan. Although a number of air mixers have been developed for bringing together and mixing two different air streams, often these air mixers are not very efficient and/or they require a substantial amount of space in the building in order to function properly. The two air streams that often must be mixed in an air handling system are generally return air that is coming back from the building itself and fresh outside air. In cold weather, the return air will normally be quite warm, for example, room temperature, while the outside air can often be quite cold.

In these air handling systems for buildings, air stratification that results from the momentum inherent in moving air streams can keep air streams of different temperatures from mixing for quite some distance. This in turn can cause the air handling system to operate poorly or inefficiently and can also result in poor indoor air quality. During the winter time, lack of proper mixing of the incoming air streams can result in freezing or damage of heating coils that are part of the heating system and can generate control sensor errors. During the summer, poor mixing of the air streams can result in the lack of proper control of the indoor air temperature and can increase the energy consumption of the air conditioning system. The heat transfer capacities at the cooling coils are based on airflow at uniform temperature and velocity across the coils. A non-uniform temperature distribution for the entering air will cause reduced heat transfer at the coils and the desired temperature in the building may not be maintained.

Moreover, the problems caused by poor mixing of air streams are becoming more serious as the amount of outdoor air is increased in the air distribution system. It is noted that government regulations and building users are now often requiring a greater amount of outdoor air. An increased amount of air is now being required by IAQ standards such as ASHRAE Standard 62.

Various solutions have been proposed in the past to prevent air stratification in an air handling system and to prevent the damage that it can cause to the system. For example, glycol additives have been used to prevent frozen heat transfer coils. Although such additives may prevent frozen coils, they do not prevent the problem of reduction in heat transfer capacity of the coils due to uneven air temperature of the entering air. Dampers and high velocity jets have also been used to help in the mixing of two or more air streams but often the use of such devices creates unacceptable levels of pressure drop in the system. Specially designed air mixers have also been proposed in the past and these can improve the mixing of the air streams. However, these known mixers have some inherent defects which can be caused by the air streams being forced to pass through a narrow cross-section of the mixer. These known air mixers generally require more downstream space, can create a non-uniform downstream velocity profile and can cause a high pressure drop across the mixer. In addition, a non-uniform velocity profile caused by the air mixer can generate an extra pressure drop at downstream filter and coil sections.

An early form of air mixer is shown and described in U.S. Pat. No. 1,395,938 issued Nov. 1, 1921 to P. Barducci. In this mixer, two different air streams enter the casing of the mixer at an angle of about 90 degrees to one another. A number of boxes are arranged across the width of the air duct formed by the casing and these boxes open into an inlet duct at the side of the casing. The boxes are arranged side-by-side and are spaced apart from each other. All the boxes are provided with mouths that are open in the direction of the air flow. A main incoming air flow passes between these boxes and creates a suction effect at the mouths of the boxes so as to draw air in through the side inlet and into the downstream end of the casing where the two air streams are mixed.

More recent U.S. Pat. No. 5,463,967 issued Nov. 7, 1995 to Airflow Sciences Corporation describes a static mixer designed for use with a coal-fired power plant. The mixer has a series of parallel walls arranged in side-by-side spaced apart relationship to form a series of rectangular spaces. The perimeters of these spaces are selectively closed to define respective first and second inlets and an outlet. The mixer creates interleaving of the two air streams and thus promotes increased homogeneity some distance downstream of the confluence of the streams. This known mixer also has turning vanes for turning one of the sub-divided streams as it passes through the mixer.

It is an object of the present invention to provide an improved air mixer that can help avoid undesirable air stratification in the plenum of an air distribution system and that at the same time has low pressure drop.

It is a further object of the present invention to provide an air mixer for an air distribution system that can be manufactured at a reasonable cost and that is highly efficient.

SUMMARY OF THE INVENTION

According to one aspect of the invention, an air mixer for an air distribution system for a building or similar structure includes a set of fixed, substantially parallel partitions arranged in a spaced-apart, side-by-side manner, these partitions forming alternating primary and secondary air passageways. The primary air passageways are open ended and extend from a front side to a rear side of the air mixer. Front end plates longitudinally across the front side of the air mixer and extend transversely and extend respectively across sides of the secondary air passageways located at the front side of the air mixer. Each plate has elongate edge portions extending along two opposite longitudinal edges thereof. Each elongate edge portion projects in a transverse direction beyond the plane defined by an adjacent one of the partitions. Air gaps are formed between the elongate edge portions and the front edges of the partitions to enable the air flow in the secondary air passageways to exit therefrom and be mixed in the primary air passageways with air flow passing through the primary air passageways from the front side of the air mixer to the rear side thereof.

Preferably a series of turbulence creating plates are mounted in each primary air passageway and are distributed across the width of their respective primary air passageway taken in a direction substantially parallel to the longitudinal edges of the front end plates.

According to another aspect of the invention, an air mixer for an air distribution system for a building or similar structure includes a set of fixed, substantially parallel partitions arranged in a spaced-apart, side-by-side manner, these partitions forming first and second groups of alternating air passageways for first and second air flows with the first group of air passageways being open ended and extending from a front side to a rear side of the air mixer. The front side provides primary air inlets for the first air flow while another side of the air mixer extending between the front and rear sides provides secondary air inlets, which are provided for the second air flow and lead into the second group of air passageways. Fixed front end plates extend longitudinally across the front side of the air mixer, extend transverserly and respectively over sides of the second group of air passageways located at the front side of the air mixer, and are adapted to direct the second air flow into the first group of air passageways in the vicinity of the front side of the air mixer. The front end plates each have opposite edge portions that extend beyond the plane of respective adjacent partitions. During use of the air mixer, the second airflow is mixed inside the air mixer with the airflow that enters the primary air inlets during the course of flowing through the first group of air passageways.

In the preferred embodiment, turbulence creating strips are mounted in the first group of air passageways in order to promote faster mixing of the first and second air flows.

According to a further aspect of the invention, a plenum fan system for supplying a mixed air flow to a building or similar structure includes an enclosed plenum chamber having a return air inlet, an outside air inlet, and at least one mixed air outlet. An air supplying fan is mounted in the chamber and has a fan outlet connected to the at least one mixed air outlet. Heat exchanging coils are mounted in the chamber between the return and outside air inlets and the air supplying fan and an air mixer is mounted in the chamber between the return and outside air inlets and the heat exchanging coils. The air mixer comprises a set of spaced-apart, substantially parallel partitions arranged in side-by-side manner, these partitions forming alternating primary and secondary air passageways. The primary air passageways are operatively connected at a front side of the mixer to one of the air inlets and the secondary air passageways are operatively connected to the other of the air inlets. The primary air passageways are open ended and extend from the front side of the mixer to a rear side thereof. Front end plates extend respectively across front sides of the secondary air passageways and are adapted to direct airflow passing through the secondary air passageways into the primary air passageways. The front end plates have edge portions extending along two opposite edges thereof with each elongate edge portion projecting beyond the plane defined by an adjacent one of the partitions. During use of the system, the two air flows from the two air inlets are mixed while flowing through the primary air passageways.

Preferably the partitions are fixedly mounted in the air mixer and airflow vanes extend between and rigidly connect adjacent pairs of the partitions.

Further features and advantages will become apparent from the following detailed description taken in conjunction with the accompanying drawings.

DETAILED DESCRIPTION OF PREFERRED EMBODIMENT

Figure 1:
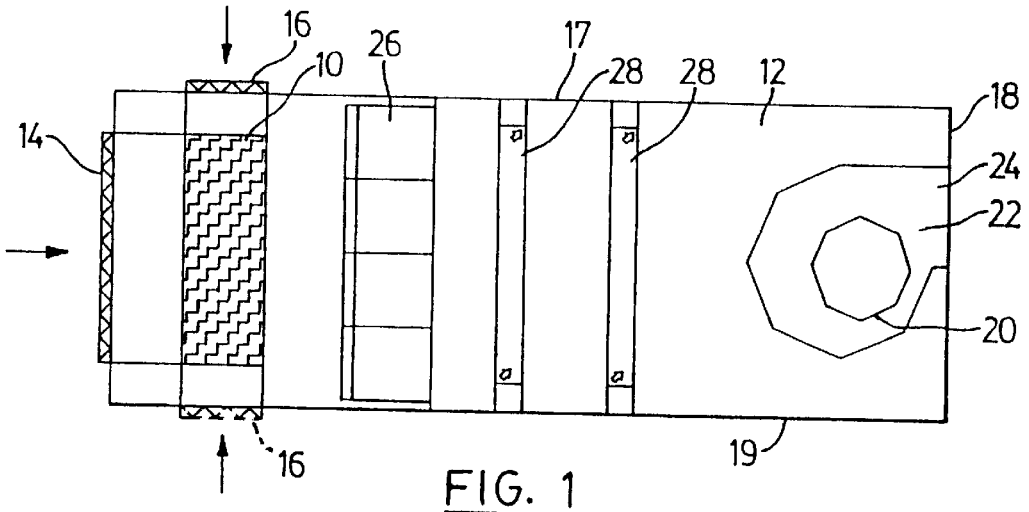
FIG. 1 is a schematic elevation of a plenum chamber with an air mixer constructed in accordance with the invention.

An air mixer unit or module is illustrated in FIGS. 2 to 5 of the drawings. This air mixer 10 is particularly useful for an air distribution system for a building or similar structure. Major components of a plenum fan system constructed with the air mixer of the invention are illustrated in FIG. 1. It will be understood that plenum fan systems per se are well known in the air distribution industry and it is the air mixer aspect of this plenum fan system that constitutes the novel component of this invention. Illustrated in FIG. 1 is a plenum chamber 12 having a first air inlet 14 located at the front side of the air mixer and a second air inlet 16 located at one side, in this case the top, of the air mixer. Not illustrated in detail are chamber sidewalls located at 17 to 19. Also, another possible location for the second air inlet is in the floor of the plenum chamber, this being indicated in dash lines in FIG. 1. These side walls can be insulated, if desired, to reduce the amount of sound emanating from the chamber which contains an air supplying fan 20. Although a centrifugal fan is illustrated schematically, a plenum or axial type fan could also be used with the air mixer of the invention. The fan 20 has a fan outlet at 22 which is connected to at least one mixed air outlet 24 of the plenum chamber. Normally, the plenum fan system will form part of an air conditioning and/or heating system for the building or structure. In this case, two banks of heat exchanging coils indicated at 28 can be mounted a short distance downstream from the air mixer 10. These banks of coils are mounted in the chamber between the location of the two air inlets and the air supplying fan 20. The banks of coils are arranged across the height and width of the chamber in a manner so that the mixed air flow from the air mixer 10 must pass through these banks of coils to reach the inlet of the fan. Preferably there are also mounted in the chamber one or more filter panels 26.

In a standard air distribution system, one of the two air inlets is for return air that is coming back to the plenum chamber from the building itself while the other air inlet is for fresh outside air. Which air inlet is chosen for a particular air flow will depend upon the building layout constraints. It will be appreciated that depending upon outside temperature conditions, there can be a substantial temperature difference between the return air flow and the outside air flow. Normally the return air will have a temperature that is close to normal room temperature, for example, around 20 degrees C. or 70 degrees F. If winter conditions exist outside, the temperature of the outdoor air could be close to or below the freezing point. On the other hand, if it is a warm summer day, the outside air could have a temperature of 30 degrees C. or more. Obviously, the mixture of these two air flows must be warmed by the heat exchanging coils (or other means) before the air mixture is distributed back into the building by the fan in the winter time. Alternatively, the heat exchange coils must cool the air mixture to some extent before it is blown through the building by the fan in the summer time.

Turning now to the construction of the air mixer 10, it is made with a set of fixed, substantially parallel partitions or panels 30 that are arranged in spaced-apart, side-by-side manner. In the illustrated unit of FIGS. 2 to 4 there are six of these partitions with the outermost two partitions indicated at 30*a* and 30*b* in FIG. 3 forming outer walls of the unit. The partitions as well as other sheet metal components of the unit in one preferred embodiment are made from 18 gauge sheet metal and it will be understood that these partitions and their connecting members and panels can be connected together in several different well known ways, for example, by welding, by screws or by riveting. In order to connect the panels or partitions at the various joints, steel angle members cut to the required length can be used, again in a manner well known in the construction of air handling units.

Figure 4:
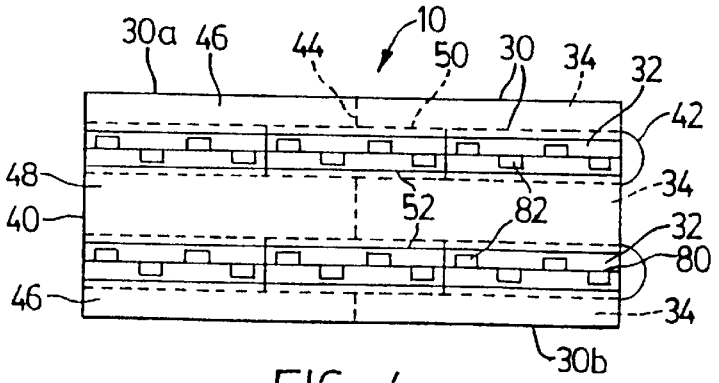
FIG. 4 is a front view of the air mixer.

The partitions 30 form alternating primary and secondary air passageways indicated at 32 and 34 respectively. The primary air passageways 32 are open ended and extend from a front side 36 to a rear side 38 of the air mixer 10. A side wall 40 is located on one side of the air mixer 10 and closes the primary and secondary air passageways on this one side. The side wall 40 extends substantially from the front side 36 to the rear side 38 of the mixer. As shown in FIG. 4, opposite the side wall 40, the primary passageways 32 are closed by semi-cylindrical end plates 42. The rounded exterior of these end plates helps to direct and split the air flow entering the mixer through the side air inlet 16. Also shown in FIG. 4 are suitable supporting bars 44 that can be rigidly mounted in the secondary passageways 34 in order to stiffen and support the partitions to which they are attached. The number and location of these bars can vary depending on the particular air mixer and the size thereof and it will be appreciated that these bars are arranged so as not to interfere significantly with the air flow through the secondary passageways.

Figure 3:
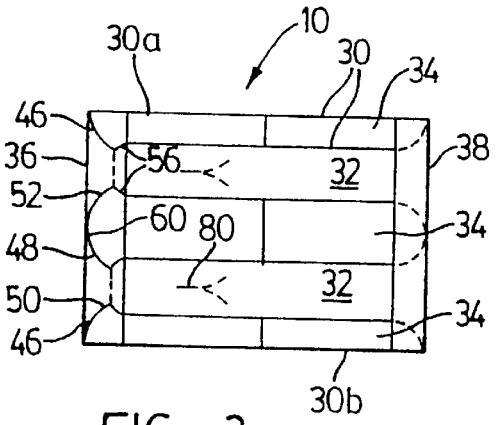
FIG. 3 is an end view of the air mixer.

Rounded front end plates 46 and 48 extend longitudinally across the front side 36 of the mixer and transversely and respectively across sides of the secondary air passageways located at the front side of the air mixer. These plates help to direct the incoming air flows through air inlet 14 into the primary passageways 32. Each of the smaller outer plates 46 has an elongate edge portion at 50 that extends along a longitudinal edge of the end plate, this edge being the inner edge in the illustrated mixer. Furthermore, the larger, central end plate 48 has two elongate edge portions 52 that extend along opposite longitudinal edges of this plate. As can be seen in FIG. 3, the elongate edge portions 50 and 52 project beyond the planes defined by respective adjacent partitions 30. Elongate air gaps or slots 56 are formed between the elongate edge portions 50, 52 and front edges of the partitions 30 to enable the air flow in the secondary air passageways 34 to exit therefrom and be mixed inside the air mixer with the airflow passing through the primary air passageways 32.

Preferably the front end plates 46, 48 each have a front surface that is convexly curved between opposite longitudinal edges thereof. As a result, each front end plate 46, 48 forms a concave inner surface 60 which faces a respective one of the secondary passageways 34. It will be appreciated that the end plates 46, 48 are adapted to direct the air flow passing through the secondary passageways 34 into the primary passageways 32 in the vicinity of the front side of the air mixer and the concave inner surface of these plates helps to direct the airflow smoothly and efficiently into the primary passageways. It will thus be seen that during use of the air mixer 10, the airflow passing through the secondary passageways 34 from the side inlet 16 is mixed with the airflow that enters the primary air inlets (located at the front end of passageway 32) during the course of flowing through the primary passageways 32. Because most of the required mixing takes place in the air mixer itself, very little, if any, mixing is required downstream of the air mixer. Thus, the air mixer 10 of the invention can be arranged quite close to or adjacent to the filters at 26.

Figure 2:
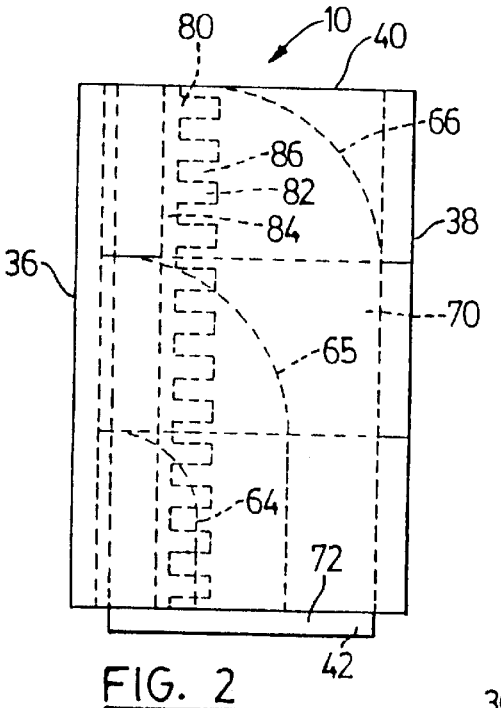
FIG. 2 is a side view of the preferred air mixer constructed in accordance with the invention.

Airflow splitters 64 to 66 are preferably mounted in the secondary air passageways 34 and the preferred shape and arrangement of these splitters can be seen from FIG. 2. Preferably there are two, three or more of these splitters in each of the secondary passageways and, during use of the air mixer, they act to turn the airflow that enters through the inlet 16 towards the front end plates. The splitters in each passageway are preferably a series of spaced-apart, bent sheet metal plates that divide the secondary air passageway into three or more smaller passageways 70 that extend from an air inlet side 72 of the mixer 10 to either the single air gap or the two air gaps 56 that are located along the front side of the respective secondary air passageway. In one preferred embodiment of the mixer, the splitters are made from 20 gauge sheet metal and each is constructed from an elongate, rectangular plate that is suitably bent to form a 90 degree curve approximately. The preferred sheet metal is non-perforated sheet steel. The splitters can also be described as airflow vanes or air directors. Each is preferably connected along two opposite longitudinal edges to an adjacent pair of the partitions 30. The provision of the splitters also provides additional support for the adjacent partitions.

It will be further appreciated that the splitters 64 to 66 promote flow uniformity from the air inlet 16 through the secondary passageways. The provision of these splitters helps to ensure that the airflow passing through the gaps 56 is reasonably uniform across the width of the mixer. This in turn helps to ensure a more uniform mixture of the two air flows exiting from the rear side 38 of the mixer. It should be appreciated that such splitters are not always required in an air mixer constructed according to the invention. Smaller air mixers may not require any air splitters in order to provide proper air mixing. It is preferred that larger capacity mixers be provided with splitters such as those shown in the drawings.

Figure 5:
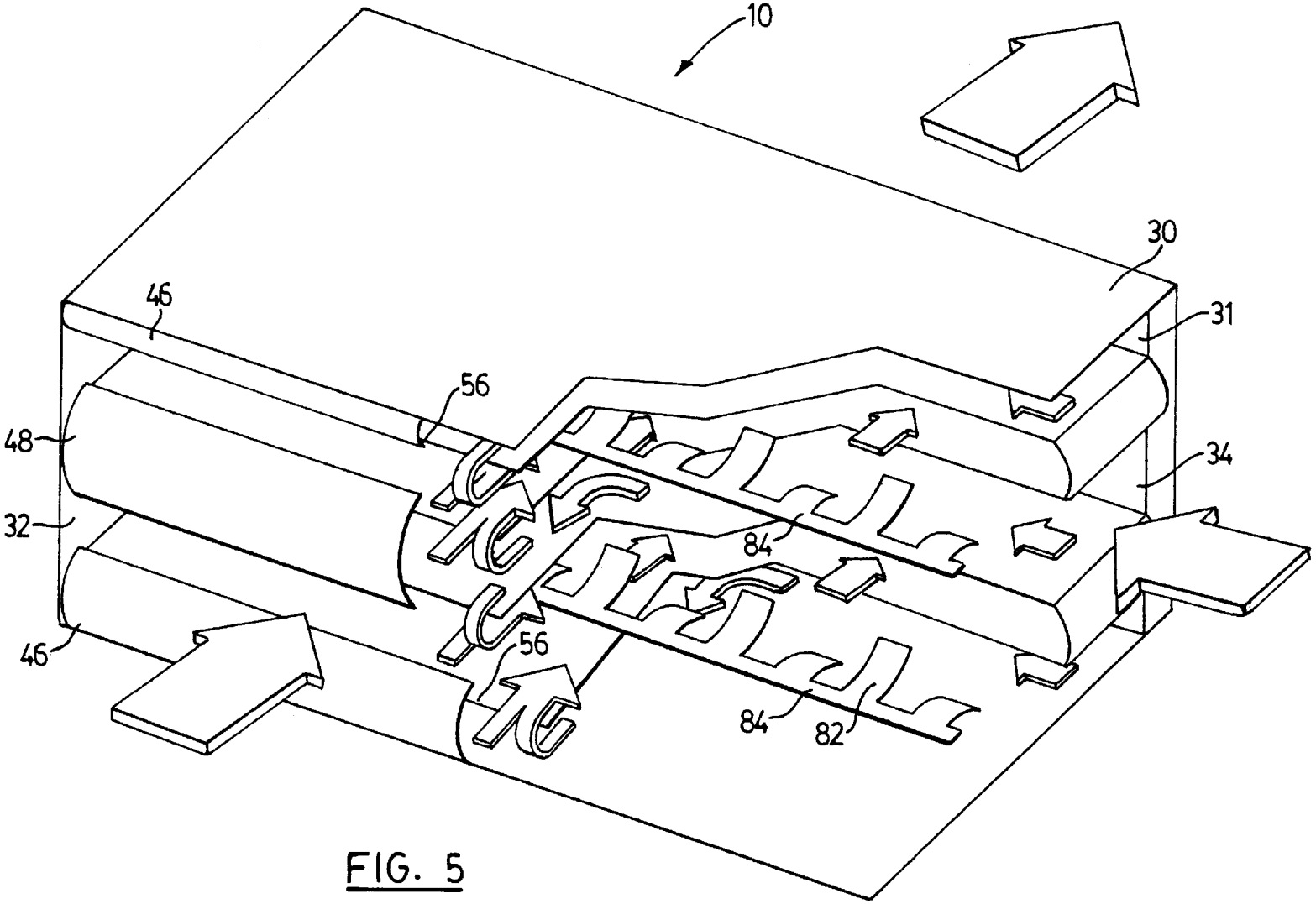
FIG. 5 is a schematic perspective view of the preferred air mixer with portions of the partitions cut away for sake of illustration.

In the preferred air mixer 10, a turbulence creating device 80 is mounted in each of the primary air passageways 32. The illustrated device includes a series of curved, spaced-apart metal plates or deflectors 82 that are distributed substantially across the width of their respective primary air passageway 32. In other words, these plates 82 are distributed in a row extending in a direction substantially parallel to the longitudinal edges of the front end plates, 46, 48. In the preferred embodiment, the metal plates 82 are integrally formed along a main support strip 84 that extends across the width of the air mixer. A relatively short air gap 86 is formed between adjacent plates. Preferably the plates are aerodynamically curved as shown in FIGS. 3 and 5. Because of their smooth curvature, these plates do not significantly reduce the air flow speed in the primary passageways but at the same time they create the required turbulence therein to provide excellent mixing of the two air flows that enter the passageway. As shown in FIGS. 3 and 4, each turbulence device is positioned approximately midway between the two parallel partitions forming the respective primary air passageway. Preferably the plates 82 are curved alternately upwardly and downwardly from a central plane that is parallel to the partitions 30. This alternate bending of the plates 82 can be seen clearly in FIG. 5. In one preferred embodiment, the metal plates or strips 82 have a length of 4.5 inches and a width of 2.5 inches. The width of the support strip 84 is 1.5 inches and the air gap between adjacent plates is 2.5 inches.

Figure 6:
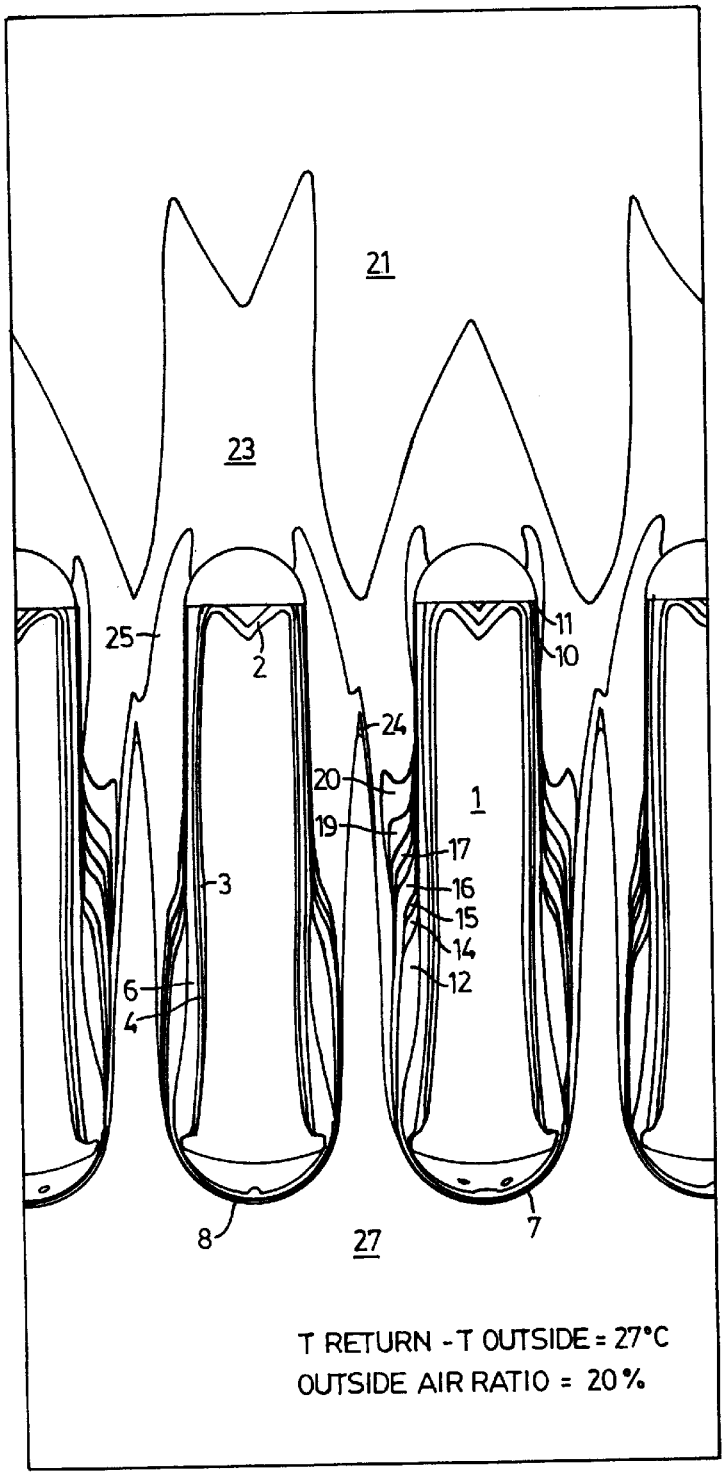
FIG. 6 is an illustration providing a theoretical, computer generated temperature profile taken along a transverse cross-section of the air mixer that is perpendicular to the direction of the air flow entering from the side of the mixer.
Figure 7:
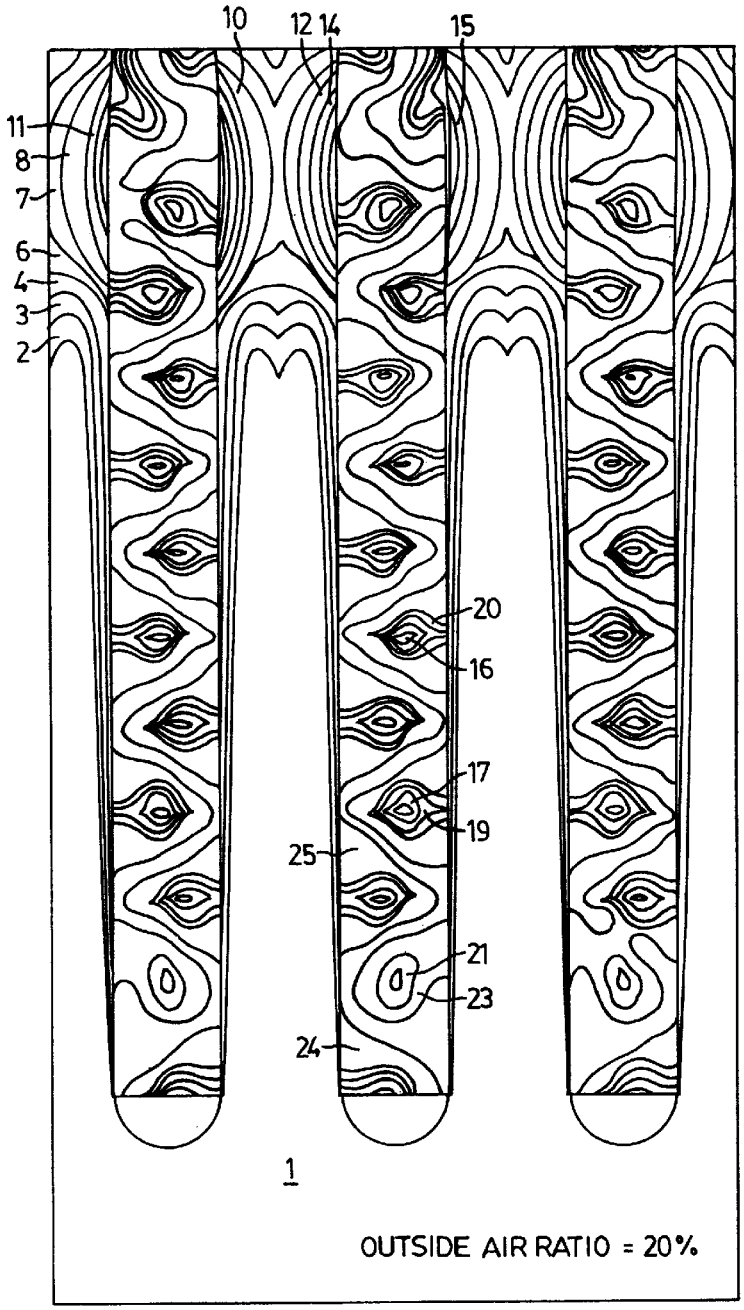
FIG. 7 is an illustration providing a theoretical, computer generated temperature profile taken along a transverse cross-section of the mixer in a direction parallel to the direction of airflow entering from the side of the mixer.

The theoretical temperature profiles of a mixer constructed according to the invention is shown by the temperature fringe plots of FIG. 6 and FIG. 7 (from Computational Fluid Dynamics (CFD) software program results). In FIGS. 6 and 7 the mixer has three primary passageways 32 and four secondary passageways 34. The temperature difference between the return air and the outside air stream is 27° C., and the outside air ratio is 20%. In an actual air temperature test of a mixer, the temperature of the airflow at each of the two air inlets was measured by a single temperature sensor while the temperature readings of the mixed airflow were taken by seven movable sensors arranged in a straight horizontal line across the width of the air mixer. The maximum distance between adjacent sensors was 7.5 inches and these sensors were controlled by a computer data acquisition system. FIG. 6 is the temperature profile on a transverse cross-section of the air mixer that is perpendicular to the direction of the air flow entering through side inlet 16 shown in FIG. 1. The temperatures are measured under steady state conditions. It is found that mixing is almost finished inside the mixer. Near the downstream end, the temperature becomes very uniform. Shown on the right side is a temperature scale with a range of 27 degrees Kelvin with a number from 1 to 27 being assigned to each of the listed temperatures measured on the Kelvin scale. Thus, the temperature at various locations in the mixer is indicated by the numbers on the drawing on the left side.

Turning to FIG. 7, this figure illustrates the temperature profile of the present air mixer on a cross-section of the air mixer in a direction parallel to the direction of airflow entering from the side inlet 16. It shows that a preferred temperature profile in the passageways 32 is generated, which is helpful to accelerate the mixing over a very short distance. As in FIG. 6, a temperature scale is provided on the right side with a number from 1 to 27 being assigned to each of the listed Kelvin temperatures. Thus, the numbers on the drawing on the left indicate the corresponding temperature reading.

In FIGS. 6 and 7, the short form E+02 stands for an exponential to the power of 2 or in other words $10^2$. Although the illustrated temperature profiles of FIGS. 6 and 7 are only theoretical readings provided by the aforementioned CFD software program, the actual measured temperatures using the aforementioned sensors were close to the thearetical projections shown.

It will be appreciated that the new air mixer 10 is able to distribute the incoming air from a side inlet of the plenum uniformly along the entire span of the plenum. With this air mixer, multiple layers of cold and warm air streams uniformly distributed across the whole cross-section of the air mixer and the use of aerodynamic stirring bars 82 enable thorough mixing of two incoming air streams in the mixer. The present mixer takes advantage of heat exchange through thin sheet metal, the interaction of air streams and the use of aerodynamic stirring bars or plates 82 that accelerate mixing over a short distance. There is a relatively low pressure drop in the mixer itself and there is no extra pressure drop created at the filter and coil sections (because of the uniform downstream velocity profile).

With the use of the preferred air mixer described herein, one can avoid undesirable freeze up of heat exchange coils and one is able to achieve more accurate temperature control in the air handling system because the air streams passing by the temperature sensing points will have a more homogeneous temperature. Furthermore, the air mixer can achieve a more even velocity profile across the air filters and heat exchange coils and this in turn leads to even filter loading and enhanced coil performance with a resulting decrease in energy consumption. Also, because of the wide effective working range of these air mixers, the user of the air distribution system can mix more outside air into the supply air stream in order to satisfy increasingly higher IAQ requirements. Because the air mixer of the present invention is so efficient, no upstream mixing box is required and generally the plenum fan system can be made more compact.

If desired, the air mixer 10 can be provided with mounting flanges formed along the outer edges for the purpose of fixedly mounting the air mixer in the plenum chamber or for connecting the air mixer to adjacent, similar air mixers. It should be noted that the air mixer 10 can be constructed as a module of standard size and these modules can be stacked one on top of the other or one beside the other in the plenum chamber in order to create a large air mixer of the required size.

It will be appreciated by those skilled in this art that various modifications and changes can be made to the described high efficiency air mixer without departing from the spirit and scope of this invention. Accordingly, all such modifications and changes as fall within the scope of the appended claims are intended to be part of this invention.

What is claimed is:

1. An air mixer for an air distribution system for a building or similar structure, said air mixer comprising:

a set of fixed, substantially parallel partitions arranged in a spaced-apart, side-by-side manner, said partitions forming alternating primary and secondary air passageways, said primary air passageways being open ended and extending from a front side of said air mixer to a rear side of said air mixer;

a side wall located on one side of said air mixer and closing said air passageways on said one side, said side wall extending substantially from said front side to said rear side of the air mixer; and front end plates extending longitudinally across said front side of the air mixer, extending transversely and respectively across sides of said secondary air passageways located at said front side of the air mixer, and having elongate edge portions extending along longitudinal edges thereof, each elongate edge portion projecting in a transverse direction beyond the plane defined by an adjacent one of said partitions, wherein air gaps are formed between said elongate edge portions and front edges of said partitions to enable the airflow in said secondary air passageways to exit therefrom and be mixed in said primary air passageways with airflow passing through said primary air passageways from said front side of the mixer to said rear side thereof.

2. An air mixer according to claim 1 including a series of turbulence creating plates mounted in each primary air passageway and distributed across the width of their respective primary air passageways taken in a direction substantially parallel to the longitudinal edges of said front end plates.

3. An air mixer according to claim 1 including airflow splitters mounted in said secondary air passageways and each connected to an adjacent pair of said partitions, said splitters in operation of the air mixer turning incoming airflow that enters the secondary air passageways towards the front end plates.

4. An air mixer according to claim 2 wherein said front end plates each have a front surface that is convexly curved between opposite longitudinal edges thereof.

5. An air mixer according to claim 4 wherein said turbulence creating plates in each primary air passageway are curved, are arranged in a single row, and are spaced apart from one another.

6. An air mixer according to claim 3 wherein said airflow splitters in each secondary air passageway are a series of spaced-apart bent metal plates that divide the secondary air passageway into three or more smaller passageways that extend from an air inlet side of the air mixer to at least one of said air gaps located along the front side of the air mixer.

7. An air mixer according to claim 6 wherein each airflow splitter bends through an angle of about 90 degrees and is made of non-perforated sheet metal.

8. An air mixer according to claim 5 wherein said turbulence creating plates are integrally formed along a straight, elongate, supporting strip that is positioned approximately midway between the two partitions forming the respective primary air passageway, each supporting strip extending in a direction generally parallel to said longitudinal edges of the front end plates.

9. An air mixer for an air distribution system for a building or similar structure, said air mixer comprising:

a set of fixed, substantially parallel partitions arranged in a spaced-apart, side-by-side manner, said partitions forming first and second groups of alternating air passageways for first and second air flows, said first group of air passageways being open ended and extending from a front side of the air mixer to a rear side of the air mixer, said front side providing primary air inlets for said first air flow, another side of said air mixer extending between said front and rear sides providing secondary air inlets, which are provided for said second airflow and lead into said second group of air passageways; and fixed front end plates extending longitudinally across said front side of the air mixer, extending transversely and respectively over sides of said second group of air passageways located at said front side of the air mixer, and adapted to direct said second air flow into said first group of air passageways in the vicinity of said front side of the air mixer, said front end plates each having opposite edge portions that extend beyond the plane of respective adjacent partitions, wherein during use of the air mixer, said second airflow is mixed inside said air mixer with the airflow that enters said primary air inlets during the course of flowing through said first group of air passageways.

10. An air mixer according to claim 9 wherein turbulence creating strips are mounted in said first group of air passageways in order to promote mixing of said first and second air flows.

11. An air mixer according to claim 10 including airflow vanes mounted in said second group of air passageways and arranged to direct the second airflow towards said front side of the air mixer.

12. An air mixer according to claim 10 wherein said turbulence creating strips are arranged in row extending across the width of each air passageway in said first group with the strips in each row being spaced apart and curved in the longitudinal direction of each strip.

13. An air mixer according to claim 12 wherein the strips in each row are curved alternately upwardly and downwardly from a central plane that is parallel to said partitions.

14. An air mixer according to claim 11 wherein there are two or more of said airflow vanes mounted in each air passageway of said second group and each airflow vane is a metal dividing plate that bends about 90 degrees and that is connected along two opposite edges to an adjacent pair of said partitions.

15. An air mixer according to claim 10 wherein air gaps are formed between said front end plates and front edges of adjacent ones of said partitions to enable airflow from said second group of air passageways to said first group.

16. An air mixer according to claim 15 wherein each front end plate is curved between bottom and top edges thereof whereby each front end plate forms a concave inner surface facing a respective one of the air passageways of the second group.

17. A plenum fan system for supplying a mixed airflow to a building or similar structure, said system comprising:

an enclosed plenum chamber having a return air inlet, an outside air inlet and at least one mixed air outlet;

an air supplying fan mounted in said chamber and having a fan outlet connected to said at least one mixed air outlet;

heat exchanging coils mounted in said chamber between said return and outside air inlets and said air supplying fan; and an air mixer mounted in said chamber between said return and outside air inlets and said heat exchanging coils, said air mixer comprising a set of spaced-apart, substantially parallel partitions arranged in side-by-side manner, said partitions forming alternating primary and secondary air passageways with the primary air passageways being operatively connected at a front side of said air mixer to one of said air inlets and the secondary air passageways being operatively connected to the other of said air inlets, said primary air passageways being open ended and extending from said front side of the air mixer to a rear side thereof, and front end plates extending longitudinally across said front side of the air mixer, extending transversely and respectively across sides of said secondary air passageways located at said front side of the air mixer, and adapted to direct airflow passing through said secondary air passageways into said primary air passageways, said front end plates having edge portions extending along two opposite edges thereof with each elongate edge portion projecting beyond the plane defined by an adjacent one of said partitions, wherein, during use of said system, two air flows from the two air inlets are mixed in said air mixer while flowing through said primary air passageways.

18. A plenum fan system according to claim 17 including a turbulence creating device mounted in each of said primary air passageways.

19. A plenum fan system according to claim 18 wherein each turbulence creating device includes a series of curved, spaced-apart metal strips that are distributed substantially across the width of their respective primary air passageway.

20. A plenum fan system according to claim 17 wherein said front end plates each have elongate top and bottom edges and are curved between said top and bottom edges whereby each front end plate forms a concave inner surface facing a respective one of the secondary air passageways.

21. A plenum fan system according to claim 18 including airflow vanes mounted in said secondary air passageways and arranged to direct airflow from the other of said air inlets towards the front side of the air mixer.

22. A plenum fan system according to claim 21 wherein said partitions are fixedly mounted in the air mixer and said airflow vanes extend between and rigidly connect adjacent pairs of partitions.

23. A plenum fan system according to claim 22 wherein said airflow vanes are curved airflow splitters that bend through an angle of about 90 degrees.

24. A plenum fan system according to claim 17 including air filters mounted in said chamber between said return and outside air inlets and said air supply fan.

* * * * *